US009284706B2

(12) United States Patent
Roodenburg et al.

(10) Patent No.: US 9,284,706 B2
(45) Date of Patent: Mar. 15, 2016

(54) OFFSHORE SYSTEM COMPRISING A RIG AND A CANTILEVER

(71) Applicant: ITREC B.V., Schiedam (NL)

(72) Inventors: Joop Roodenburg, Delft (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 14/383,476

(22) PCT Filed: Feb. 27, 2013

(86) PCT No.: PCT/NL2013/050119

§ 371 (c)(1),
(2) Date: Sep. 5, 2014

(87) PCT Pub. No.: WO2013/133694

PCT Pub. Date: Sep. 12, 2013

(65) Prior Publication Data

US 2015/0034383 A1 Feb. 5, 2015

(30) Foreign Application Priority Data

Mar. 6, 2012 (NL) ..... 2008415
Jul. 6, 2012 (NL) ..... 2009149

(51) Int. Cl.

| | |
|---|---|
| ***E02B 17/00*** | (2006.01) |
| ***E02B 7/12*** | (2006.01) |
| ***E02B 17/08*** | (2006.01) |
| ***E21B 15/02*** | (2006.01) |
| ***E21B 15/00*** | (2006.01) |

(Continued)

(52) U.S. Cl.
CPC . *E02B 17/00* (2013.01); *B66C 5/10* (2013.01); *B66C 23/52* (2013.01); *E02B 17/021* (2013.01); *E02B 17/08* (2013.01); *E21B 7/12* (2013.01);

(Continued)

(58) Field of Classification Search
CPC ..... E02B 17/00; E02B 17/08; E02B 17/021; E02B 2017/0056; E21B 7/12; E21B 15/02; E21B 15/003; B66C 5/10; B66C 23/52
USPC ..... 175/5, 9; 405/201, 202, 196, 195.1
See application file for complete search history.

(56) References Cited

U.S. PATENT DOCUMENTS 4,401,398 A * 8/1983 Remson ..... 405/201
6,729,804 B1 5/2004 Roodenburg et al.

(Continued)

FOREIGN PATENT DOCUMENTS

WO WO 2012/144952 A1 10/2012
WO WO 2014120085 A1 * 8/2014 ..... E21B 7/128

*Primary Examiner* — James G Sayre
(74) *Attorney, Agent, or Firm* — Birch, Stewart, Kolasch & Birch, LLP

(57) ABSTRACT

An offshore system with a rig and a cantilever having a rigid cantilever structure with an operational end. The rig is provided with a first support rail which extends along a side of the deck supporting structure. Travelling and swivelling assemblies are arranged between the first support rail and the cantilever beams. The rig is provided with one or more second support rails that extend over the deck in a direction transverse to the first support rail. The system has a cantilever inner end carrier device travels over and engages on said one or more second support rails. This device is connected via a vertical pivot axis swivel to a connector part of the rigid cantilever structure at or near its inner end to provide a rotation axis at a fixed location relative to the structure for the rotational motion of the cantilever, the cantilever inner end carrier device holding the cantilever inner end relative to the deck.

16 Claims, 7 Drawing Sheets

(51) Int. Cl.

| | |
|---|---|
| ***E02B 17/02*** | (2006.01) |
| ***B66C 5/10*** | (2006.01) |
| ***B66C 23/52*** | (2006.01) |
| ***E21B 7/12*** | (2006.01) |

(52) U.S. Cl.
CPC ..... *E21B 15/003* (2013.01); *E21B 15/02* (2013.01); *E02B 2017/0056* (2013.01)

(56) References Cited

U.S. PATENT DOCUMENTS

| | | | | |
|---|---|---|---|---|
| 7,083,004 | B2 | 8/2006 | Roodenburg et al. | |
| 2010/0260555 | A1 | 10/2010 | Foo et al. | |
| 2014/0270974 | A1 * | 9/2014 | Seng et al. | 405/201 |

* cited by examiner

OFFSHORE SYSTEM COMPRISING A RIG AND A CANTILEVER

FIELD OF THE INVENTION

The invention relates to an offshore system comprising rig with a deck and a cantilever mounted in a movable manner on the deck. In an embodiment the cantilever has a drilling station at an operational end of the cantilever which can be positioned in overboard extended position to perform drilling and/or other borehole activities with use of the drilling station. The drilling station can be an integral part of the cantilever, e.g. a single or dual firing line drilling station, or a mobile drilling station that is arranged at the operational end when drilling or borehole related activities are to be performed with said drilling station.

BACKGROUND OF THE INVENTION

In the field of cantilever type drilling rigs a known design has an X-Y movable cantilever that is mounted on a pair of support rails that extend parallel to a side of the rig to allow for translation of the cantilever along the side of the rig. The cantilever is movable at right angles to these support rails to vary the overboard extension of the cantilever. For example the U.S. Pat. No. 6,729,804 describes a drilling rig having a jack-up deck supporting structure deck with a deck, a cantilever and a supporting cart disposed between the cantilever and the deck. The supporting cart slides along the side of the deck whilst the cantilever slides at right angles thereto on the supporting cart on four friction reducing bearings.

The U.S. Pat. No. 7,083,004 describes alternatives to an X-Y movable cantilever which are aimed at increasing the drilling envelope, i.e. the area outside the deck that can be reached with drilling or borehole equipment on the cantilever by moving the cantilever into extended position. This known offshore drilling system has a rig with a deck, a cantilever and a supporting cart arranged between the cantilever and the deck. The supporting cart is pivotal about a vertical axis swivel arranged on the deck of the rig, whilst the cantilever can slide in its longitudinal direction on the supporting cart. The swivel is disclosed to be arranged at a fixed position on the deck or movable along a rail that extends over the centre of the deck, parallel to the overboarding side of the deck. In these alternative designs the cantilever is mounted on the deck so as to be movable in longitudinal direction of the cantilever, in rotational direction, and in combinations thereof.

The document US2010/0260555 also relates to an offshore drilling system with a rig having a deck and a cantilever, wherein the cantilever is mounted on the deck so as to be movable in longitudinal direction of the cantilever, in rotational direction, and in combinations thereof. Herein the rig has a pair of substantially parallel support rails extending along a side of the deck. The cantilever is provided with two parallel cantilever beams extending in longitudinal direction of the cantilever structure. A travelling and swilling assembly is arranged at each interposition of the two support rails and the two cantilever beams. Herein each assembly comprises an upper sliding block, a lower sliding block and a swivel member interconnecting the upper and lower sliding blocks, such that the assembly is moveable relatively on the relevant rails and cantilever beam to translate and/or rotate the cantilever with respect to the deck.

In cantilever type drilling rigs the weight of the cantilever and the loads to which the cantilever is subjected during drilling or borehole operations lead to enormous mechanical loads on the relevant parts of the system.

OBJECT OF THE INVENTION

According to a a first aspect of the present invention aims to provide an improved structural design of an offshore system with a rig and a cantilever that is mounted on the deck so as to be movable in longitudinal direction of the cantilever, in rotational direction, and in combinations thereof.

SUMMARY OF THE INVENTION

According to a first aspect thereof the invention achieves this aim by providing an offshore drilling system, wherein the rig is provided with one or more second support rails that extend over the deck in a direction transverse to the first support rail, and wherein the system comprises a cantilever inner end carrier device which travels over and engages on said one or more second support rails, and wherein the cantilever inner end carrier device is connected via a vertical pivot axis swivel to a connector part of the rigid cantilever structure at or near its inner end to provide a rotation axis at a fixed location relative to the rigid cantilever structure for the rotational motion of the cantilever, the cantilever inner end carrier device holding the cantilever inner end relative to the deck.

In the first aspect of the invention the pivot axis of the vertical pivot axis swivel at or near the inner end of the rigid cantilever structure is at a fixed distance from the operational end of the cantilever, independent of the extension of the cantilever over the side. This leads to a simpler and more robust structure of the system than in the U.S. Pat. No. 7,083,004 designs where the cantilever forms a telescoping structure in combination with the supporting cart that is pivotal about a pivot point on the deck. The inventive structure also reduces, at least in relative terms, the mechanical loading of the deck supporting structure or deck box compared to the US2010/026055 where the cantilever loads are to be absorbed by the two relatively closely spaced rails that are parallel to the relevant side of the deck and by the deck supporting structure underneath said two rails.

In an embodiment the rig is provided with a pair of parallel second support rails, and the cantilever inner end carrier device travels over and engages on each of said second support rails. This allows to distribute the mechanical load over a significant part of the deck supporting structure and maintain a stable mounting of the carrier device in all extended positions of the cantilever.

In an embodiment the vertical pivot axis swivel is mounted on the cantilever inner end carrier device centrally between the pair of parallel second support rails, preferably immovably secure to the carrier device.

In an embodiment the deck supporting structure is provided with a transverse bulkhead underneath the deck along the underside of each second support rail so as to transfer forces from said second support rail into the bulkhead. As is preferred two rails are mounted on top of two parallel transverse bulkheads, e.g. the bulkheads extending over the height of the deck box of a jack-up rig.

In an embodiment the first support rail is arranged above an outer side wall of the deck support structure so as to transfer forces from said first support rail into said side wall, said side wall being connected to said one or more transverse bulkheads to create an T or TT shaped arrangement of bulkheads that absorb and distribute the cantilever loads.

In an embodiment the rigid cantilever structure has two parallel cantilever beams. Between the first support rail and each cantilever beam a travelling and swivelling assembly is arranged.

In a practical embodiment the rig is a jack-up rig having a deck box as deck support structure and three or more jack-up legs.

The drilling station at the operational end of the cantilever may comprise any suitable equipment for effecting activities related to drilling or borehole operations in the offshore oil and gas industry. These may include for instance drilling tools, maintenance tools or well intervention tools, lifting equipment for lowering or retrieving subsea equipment, such as wellhead equipment, etc.

The drilling station preferably includes a drilling mast, tower, or derrick that is provided at the operational end of the cantilever. Preferably a multi-purpose tower is mounted on the cantilever. The multi-purpose tower e.g. can comprise drilling equipment, lifting equipment, etc.

The drilling station may be a mobile drilling station, that can be placed at the operational end of the cantilever when desired.

A drill floor can be provided on a cantilever top deck of the cantilever, a portion of the top deck being open from above to allow loading of drilling tubulars etc. onto the top deck, e.g. with the help of one or more cranes mounted on the deck of the rig.

A second aspect of the present invention relates to the versatility of a rig with a cantilever. As mentioned above known cantilevers commonly are designed to perform drilling activities and other borehole related activities. This may, as is known, include e.g. BOP (blow out preventer) handling along the firing line, which requires the presence of significant lifting capacity in the drilling station in view of the weight of BOP's. It is also known to provide a gantry crane on the top of the cantilever to manipulate drilling tubulars, e.g. crates containing such tubulars, on said cantilever top.

To perform lifting operation outside the contour of the cantilever it is known to mount one or more pedestal cranes at fixed locations on the deck of the rig. These cranes commonly have a reach to beyond the contour of the deck of the rig, e.g. allowing to pick-up loads from tender vessels positioned close to the rig. Also one or more said crane can commonly reach above the cantilever to place loads on the cantilever, e.g. drilling equipment and/or tubulars.

The second aspect of the present invention aims to enhance the versatility of a rig with cantilever.

The second aspect of the present invention achieves this aim by providing a rig wherein the cantilever is provided with a crane having a crane base and a main crane boom that is slewable about a vertical axis, preferably revolvable about 360°, and that is pivotable about a horizontal axis, e.g. by a luffing cable and winch, wherein the cantilever structure is provided with a pair of parallel crane support rails extending in longitudinal direction of the cantilever, and wherein the crane base travels over and engages on each of said crane support rails, wherein said crane having an operational reach extending beyond the contour of the cantilever, at least beyond the operational end of the cantilever.

Compared to a crane at a fixed location on deck of the rig, as in the prior art, this crane on the cantilever can benefit from the extension capabilities of the cantilever to enhance its reach and/or effective lifting capabilities. For instance this crane may be less, or not at all, hindered by any jack-up legs as are commonly present in a jack-up rig at either side of the cantilever and thereby have a great operational envelope for hoisting activities beyond the contour of the cantilever (including in extended position of the cantilever).

In an embodiment of the second aspect of the invention the cantilever has at its operational end a drilling deck portion that is adapted to place a mobile drilling station thereon. The crane support rails extend along the sides of said drilling deck portion allowing to place the crane base close to the operational end when no mobile drilling station is present on said drilling deck portion.

In an embodiment the crane support rails extend over at least 80% of the length of the cantilever, preferably over the entire length of the cantilever.

In view of structural stability it is preferred that the rigid cantilever structure has two parallel cantilever beams at its bottom side, wherein the crane support rails are each mounted vertically above a respective cantilever beam, and wherein the cantilever structure includes a vertical and load bearing wall between each cantilever beam and crane support rail there above. For example each wall is a latticed structure, possibly clad with panels to provide an interior space in the cantilever that is sheltered from the environment.

In view of operational reach of the crane it is proposed as an embodiment that the main boom of the crane is longer than the length of the cantilever.

If desired, as is known in the art, the main boom main be of adaptable length, e.g. composed a interconnected boom sections, e.g. latticed boom section.

In an advantageous embodiment of the second aspect of the invention the cantilever has a top side with a flush horizontal cantilever deck, possibly with a hatch covered opening therein at a location for a firing line for drilling activities to be performed with a mobile drilling station that can be placed on said flush horizontal deck, preferably the flush deck extending over the entire length of the cantilever structure, and wherein the crane support rails extend along opposed sides of the flush horizontal deck.

In an embodiment the crane on the cantilever is a pedestal crane having a base embodied as pedestal and a 360° revolving column on said pedestal, the column supporting one or more winches, at least one main hoist winch for a main hoist cable.

It will be appreciated that the second aspect of the invention can be readily combined with the first aspect of the invention. The skilled person will however appreciate that the second aspect of the invention can be applied with any rig having a cantilever that is at least extendible in longitudinal direction, e.g. an XY-cantilever that is extendible both in X and in Y direction, or in X direction and in a direction of rotation, e.g. as in the cited prior art or according to the first aspect of the invention.

In an embodiment, the length of the rigid cantilever structure is between 30-80 meters.

The rig can be a member of the group: a compliant tower, a deep draft Caisson vessel, a SPAR, a tension leg platform, temporary tension leg platform, a semi-submersible rig, a jack-up rig, and a monohull drilling or well maintenance vessel.

The present invention also relates to methods of performing offshore activities, e.g. drilling or other borehole related activities, wherein use is made of a system according to the first and/or second aspect of the invention.

For example the invention envisages a method for use of a system according to the second aspect of the invention wherein—for performing drilling or borehole related activities—a mobile drilling station is placed on a mobile drilling station deck at the operational end of the cantilever, preferably the cantilever having an opening therein at a location for a firing line for drilling activities to be performed with the mobile drilling station, e.g. a hatch covered opening, and wherein—for performing lifting activities with the crane on the cantilever—the mobile drilling station is cleared from the cantilever and the crane is travelled towards the operational end, the cantilever—if desired—being extended into an extended position thereof wherein the operational end of the cantilever extends over said side beyond the deck supporting structure thereby extending the reach of the crane relative to the rig deck.

Further preferred embodiments are disclosed in the sub-claims and the description which follows.

The present invention will be described further with reference to the appended drawings

DETAILED DESCRIPTION OF EMBODIMENTS

Figure 1:
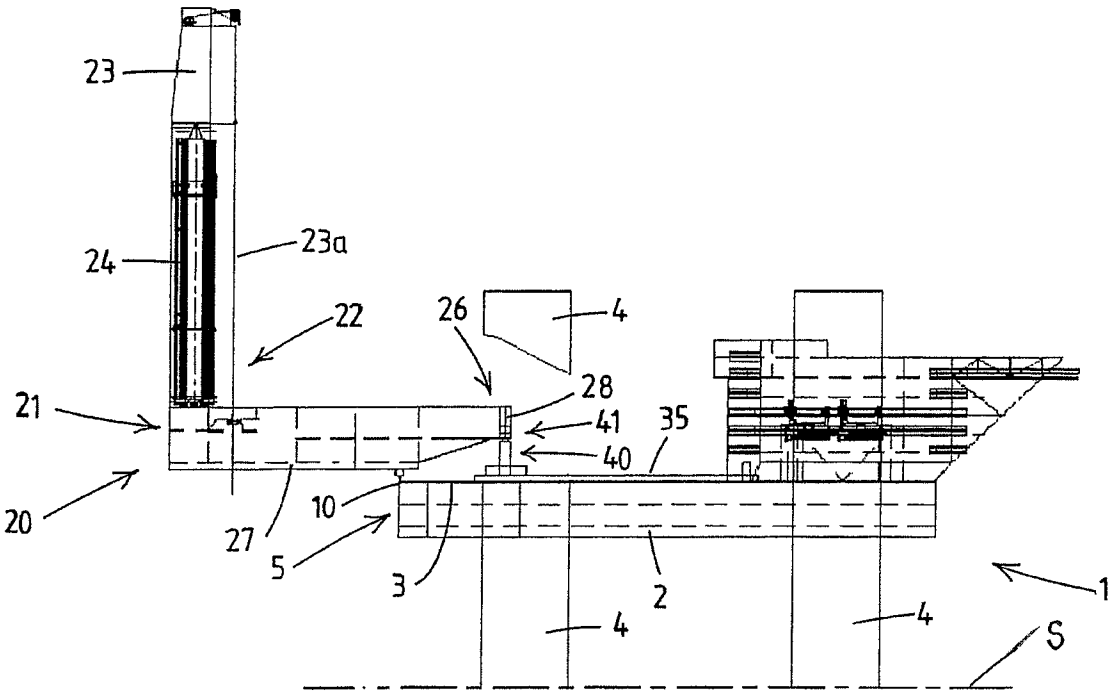
FIG. 1 shows schematically in side view an example of an offshore system according to the invention.

In FIG. 1 an offshore drilling system for offshore drilling activities, well maintenance activities, etc.

The system comprises a rig 1 and a cantilever 20.

In this example the rig 1 is a jack-up rig having a deck box as deck support structure 2 and three or more jack-up legs 4 that support the structure 2 when their feet are resting on the seafloor "s" and the structure 2 is raised above the water by means of jack-up mechanisms associated with the legs 4 as is known in the art. It is noted that the rig 1 may have other designs as well, e.g. as a semi-submersible rig, a mono-hull drilling vessel, a tension leg tower, spar buoy rig, etc.

In this example the deck box 2 is triangular in top view and the rig 1 has three jack-up legs 4; one at each corner of deck box 2 as is known in the art. In FIG. 1 a portion of a leg (in the figure at the left-hand) and its jack-up mechanism is not shown in order to better illustrate the invention.

The rig 1 has a deck 3, here the main deck of the jack-up rig. The deck box 2 has a side 5 at which the drilling and possibly other cantilever firing line related activities are performed from the cantilever 20.

The cantilever 20 has a rigid cantilever structure with an operational end 21. This operational end includes a drilling station 22 with a drill floor. In this example, as is preferred, the operational end includes a drilling mast 23, or a tower or a derrick, preferably provided with draw works.

As is preferred one or more vertical tubular storage devices, here carrousels 24, are provided at the operational end 21 as well allowing to store drilling tubulars in vertical orientation.

Additionally, as is preferred, one or more piperacker devices 25 are present to transfer tubulars between the storage devices 24 and the firing line 23*a*.

The rigid cantilever structure has an inner end 26 opposite the operational end 21. A connector part 28 of the rigid cantilever structure is present at said inner end 26.

The cantilever structure 20 in this example, as is preferred, has, here at its bottom as is preferred, two parallel cantilever beams 27 extending in the longitudinal direction of the cantilever 20. The connector part 28 is made into an integral rigid cantilever structure with the beams 27, e.g. by means of a framework of beams.

In general the cantilever 20 is supported on the deck 3 so as to be movable in a longitudinal direction of the cantilever 20, in rotational direction (arrows A, B in FIG. 2), and in combinations thereof. This allows to move the cantilever 20 between a retracted position, generally with the entire or a major portion of the cantilever 20 in vertical projection above the deck 3, and extended positions wherein the operational end of the cantilever extends over the side 5 beyond the deck box 2.

The rig 1 is provided with a first support rail 10, as is preferred a single rail, which extends along the side 5 of the deck box 2. As is preferred the rail 10 has a greater length than the distance between two adjacent legs 4 of the rig, said legs being positioned inward from said side 5 of the deck 3 wherein the rail 10 is mounted. This allows for a significant rotational motion of the cantilever and thereby enlargement of the drilling envelope.

Figure 3A:
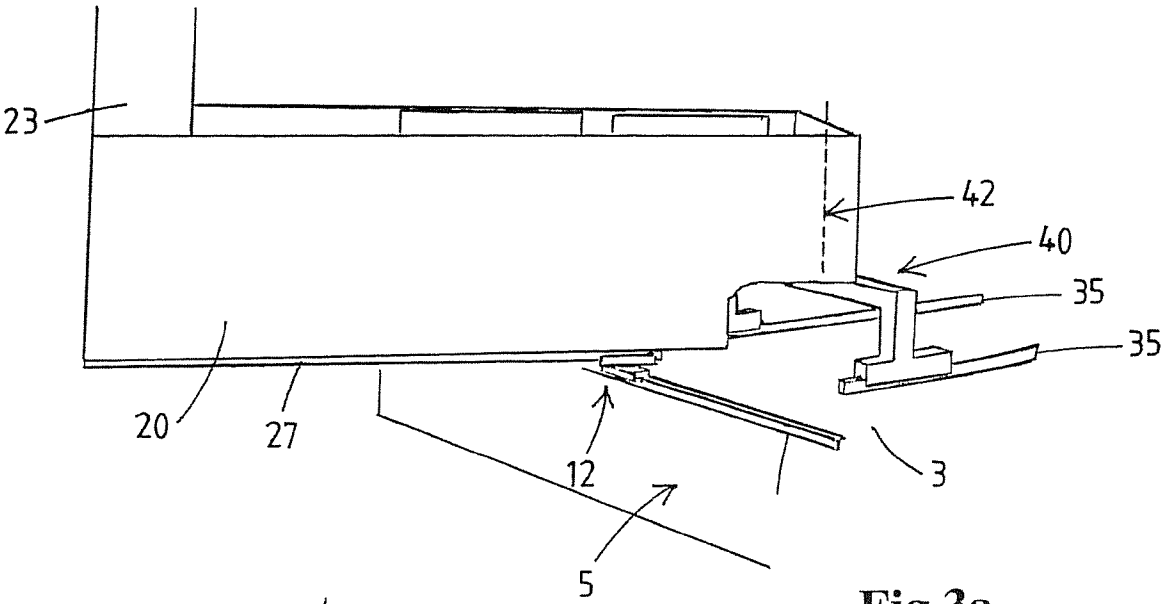
FIG. 3A shows in perspective view a part of the cantilever structure, cantilever inner end carrier device, supporting rails, and the deck supporting structure of the system of FIG. 1.
Figure 3B:
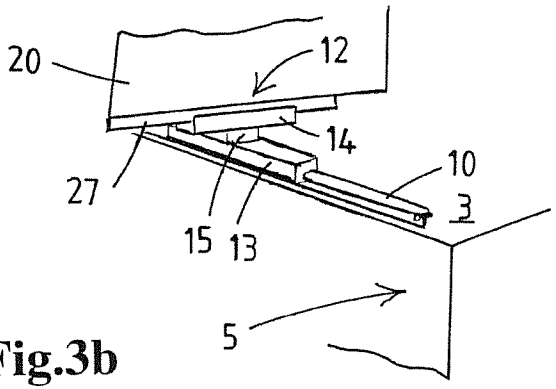
FIG. 3B shows a travelling and swivelling assembly on the first supporting rails of FIG. 3A.

As is best seen in FIGS. 3A and 3B a travelling and swivelling assembly 12 is arranged between the first support rail 10 and each of the cantilever beams 27.

Figure 2:
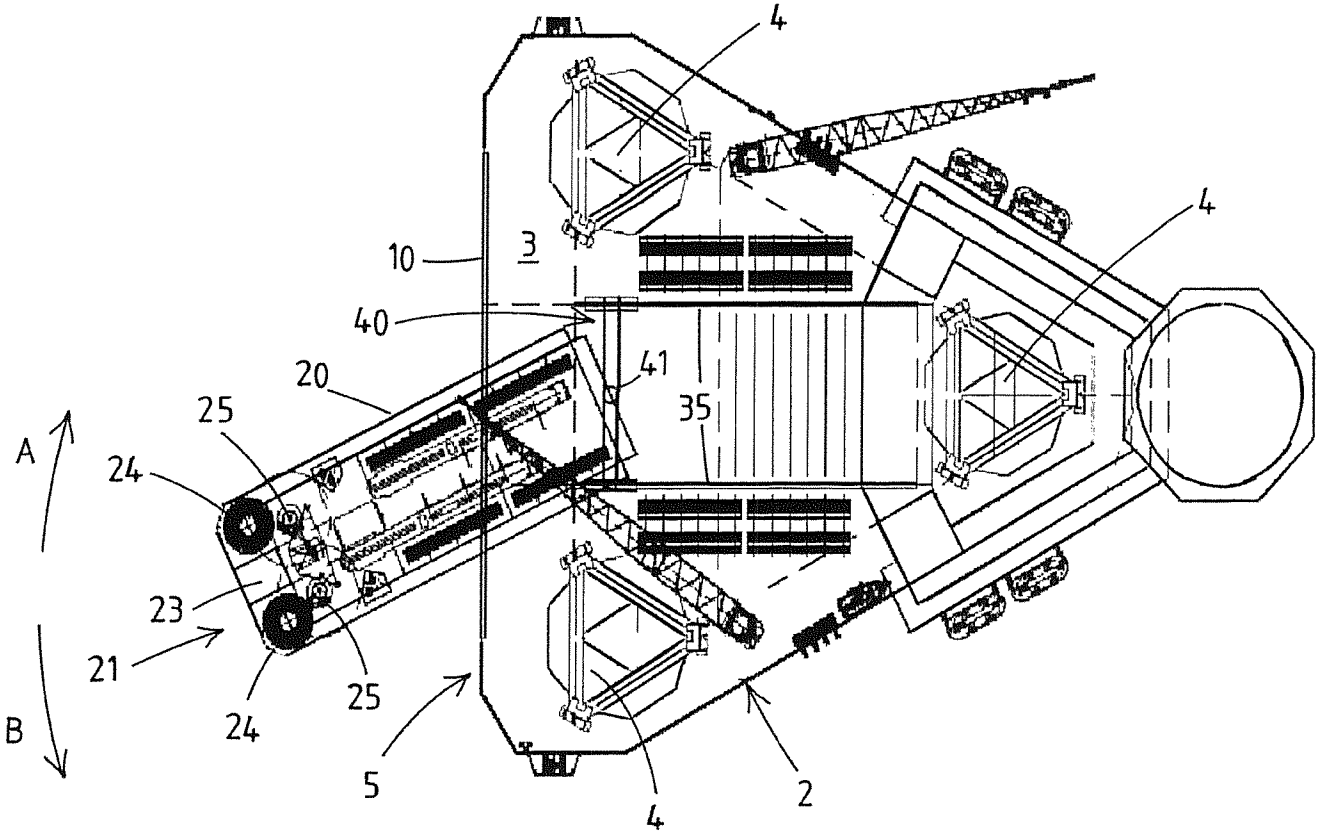
FIG. 2 shows the system of FIG. 1 from above.

Each assembly 12 has a lower member 13 which travels, e.g. skids or rolls, over the first support rail 10. It further has an upper member 14 over which the associated cantilever beam 27 travels in its longitudinal direction, e.g. by in embodied as a slide, with rollers, or otherwise. A vertical pivot axis swivel 15 is present between the lower and upper members 13, 14 of the assembly 12 to allow for rotation of the cantilever in rotational directions A and B (FIG. 2).

The rig 1 is further provided with a pair of parallel second support rails 35 that extend over the deck 3 in a direction transverse, preferably at right angles, to the first support rail 10.

The system comprises a cantilever inner end carrier device 40 which travels over and engages on each of the second support rails 35.

The rails 35, as well as the rail 10, are preferably T-shaped in cross-section with a main upper flange, e.g. having a width of at least 30 centimeters, and a vertical web between said flange and the deck 3.

The carrier device 40 is connected via a vertical pivot axis swivel 41 to the connector part 28 of the rigid cantilever structure at or near its inner end 26 to provide a rotation axis 42 at a fixed location relative to the rigid cantilever structure for the rotational motion of the cantilever 20 in directions A and B. The cantilever inner end carrier device 40 also holds the cantilever inner end relative to the deck 3 by transferring forces between the inner end 26 and the deck structure 2.

The carrier device 40 holds the cantilever inner end down when the combination of the weight of the cantilever and any forces thereon, e.g. due to drilling activities, tend to tilt the cantilever inner end upwards. The forces are then transmitted by the carrier device 40 into the rails 35. It will be appreciated that effective moment arm between the carrier device 40 and the first rail 10 depends on the actual extension of the cantilever as the axis 42 is at a fixed position relative to the cantilever and thus moves along with the longitudinal extension of the cantilever.

As can be seen, in this example, and as is preferred in the invention, the deck 3 of the rig 1 is provided with a pair of parallel second support rails 35. The cantilever inner end carrier device 40 travels over and engages on each of said second support rails 35. As preferred the vertical pivot axis swivel 41 is mounted on the cantilever inner end carrier device 40 centrally between the pair of parallel second support rails, preferably immovably secure to the carrier device 40. In another embodiment the swivel 41 could e.g. be mounted on movable on the carrier device in direction transverse with respect to the rails 35, e.g. along a rectilinear guide on the device 40.

Figure 4:
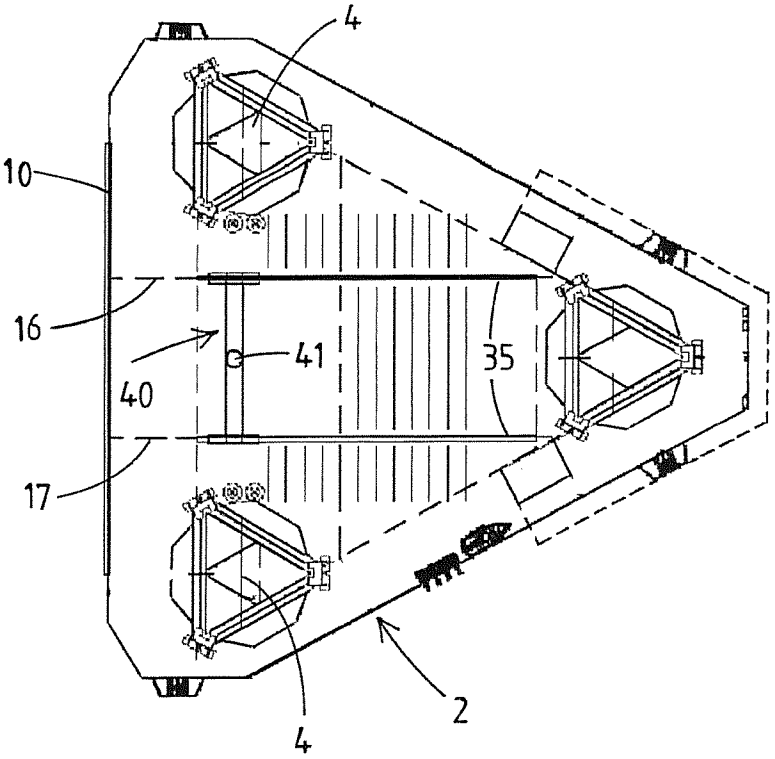
FIG. 4 shows the main deck of the rig of FIGS. 1-3 with the supporting rails and the cantilever inner end carrier device.
Figure 5:
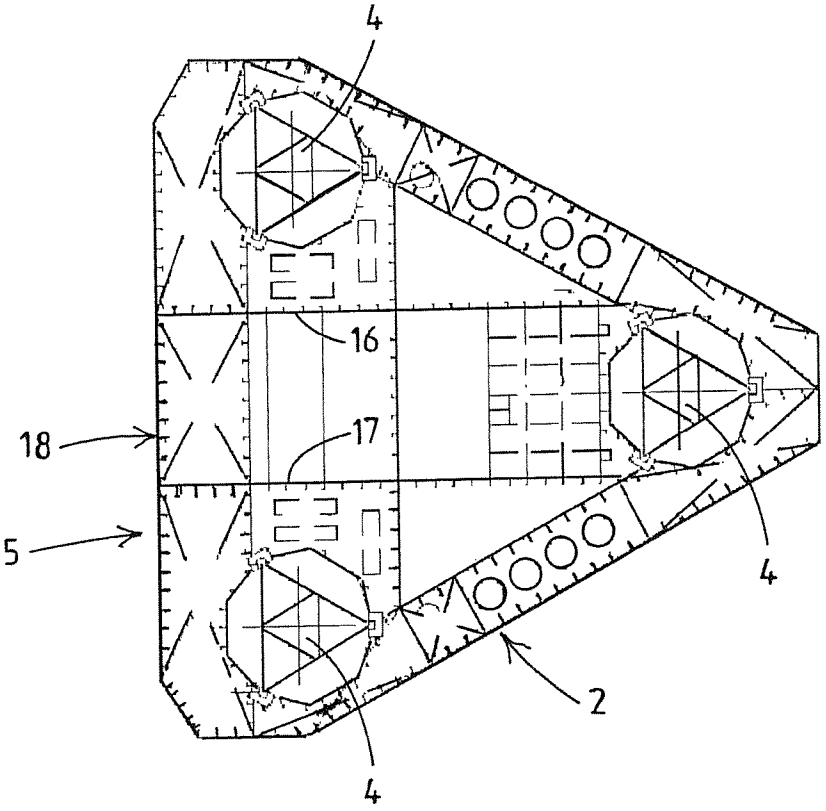
FIG. 5 shows the tween deck of the rig of FIGS. 1-4 with the bulkheads.

As can be seen in FIGS. 4 and 5 the deck supporting structure 2 is provided with a transverse bulkhead 16, 17 underneath the deck along the underside of each second support rail 35 so as to transfer forces from said second support rail into the bulkhead.

As can be seen in FIGS. 4 and 5 the first support rail is arranged above an outer side wall 18 of the deck support structure so as to transfer forces from said first support rail into said side wall 18. This wall 18 is connected to the transverse bulkheads 16, 17.

Due to this structural design the mechanical loads exerted by the cantilever are effectively absorbed and distributed into the deck box 2 by first rails 10 and the underlying wall 18, as well as by the carrier device 40, the rails 35, and the bulkheads 16, 17.

In extended position, the deck 3 is clear in the area inward of the inner end of the cantilever and may be used for e.g. storage purposes.

With reference to the example shown in FIGS. 6 and 7 now the second aspect of the invention will be explained in more detail. It will be appreciated that the offshore system in these figures also includes the first aspect of the invention, as is optional in combination with said second aspect. Parts that are the same or similar to parts in the offshore system of FIGS. 1-5 have been denoted with the same reference numerals.

Figure 6:
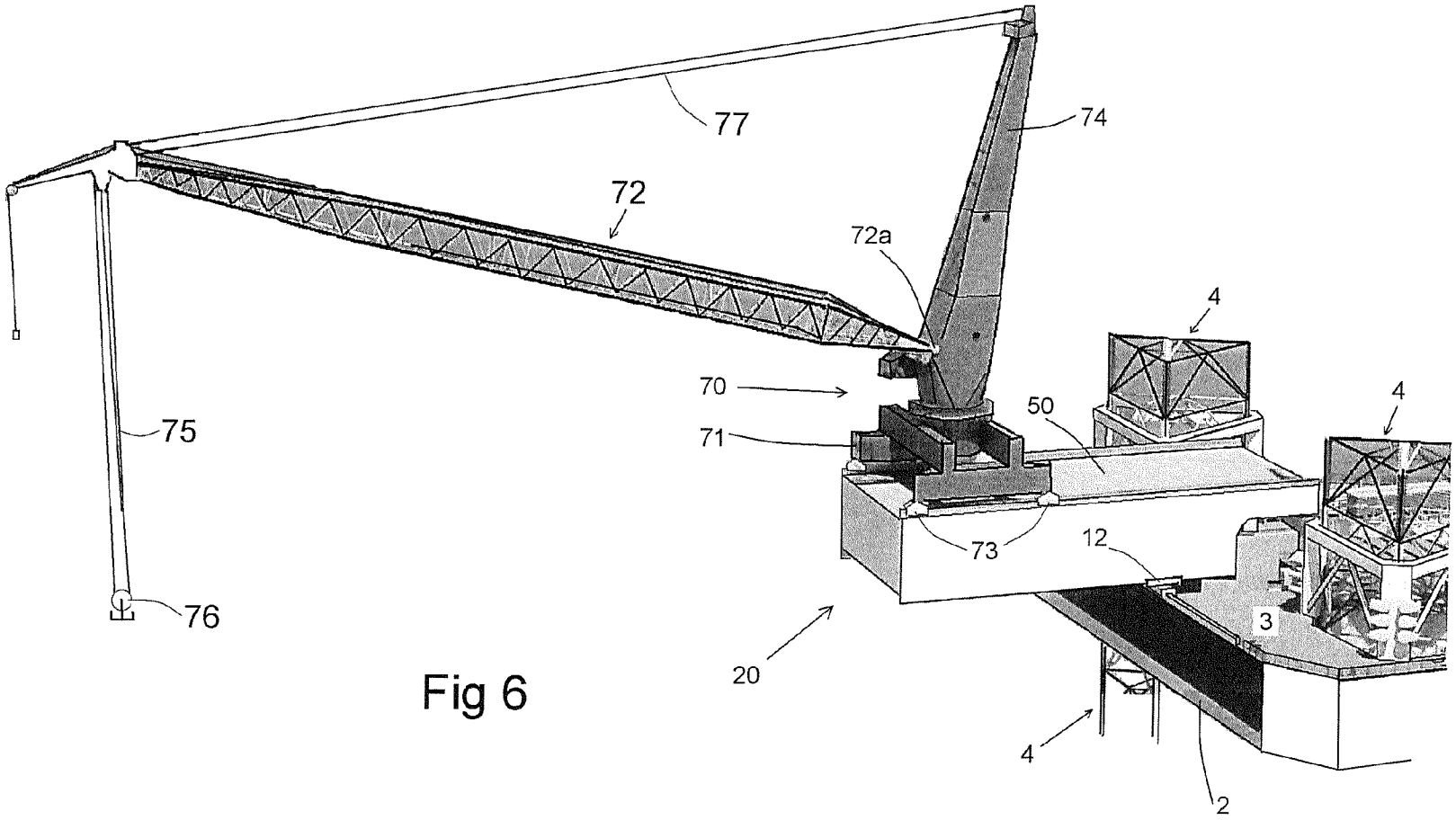
FIG. 6 shows in perspective view a portion of a system according to the first and the second aspects of the invention, with a jack-up rig and with a cantilever in an extended position, wherein a crane is present on the cantilever.
Figure 7:
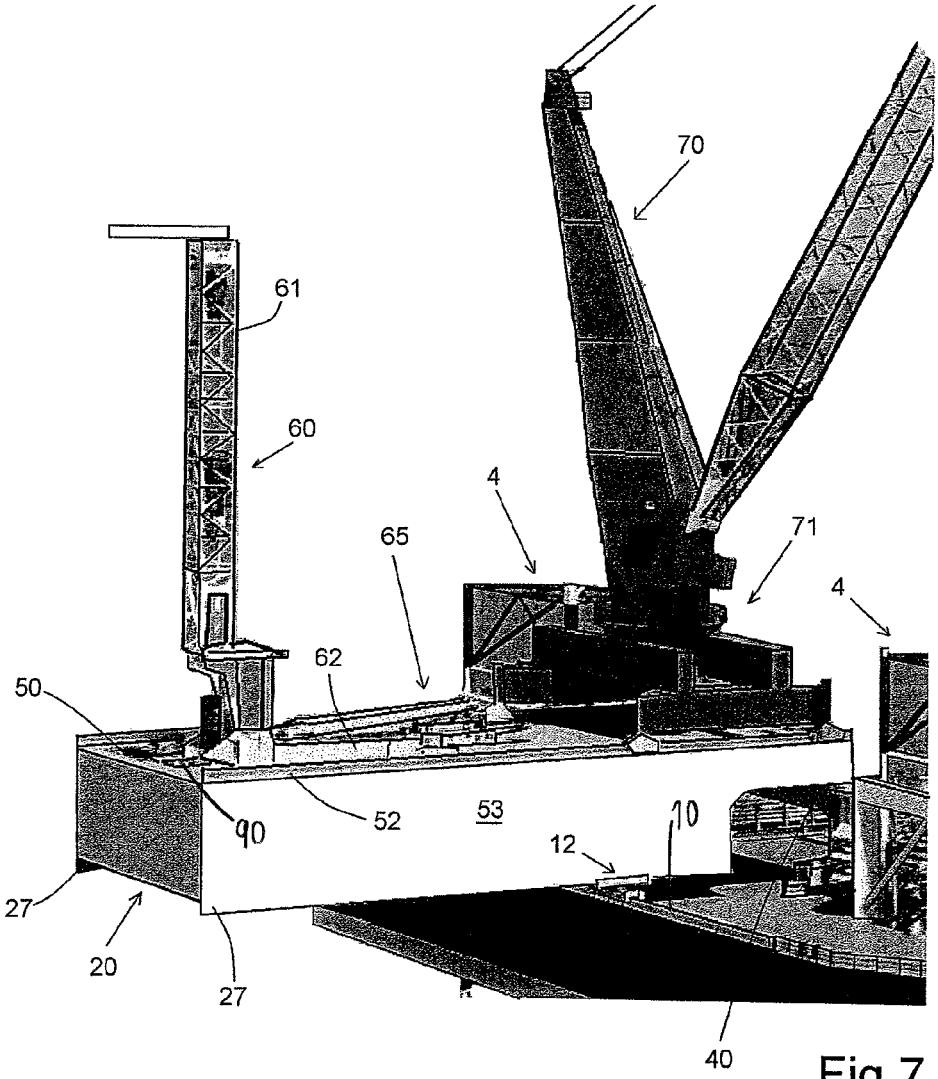
FIG. 7 shows the system of FIG. 6 with the crane arranged at the inner end of the cantilever and with a mobile drilling station placed on a flush deck on top of the cantilever.

In FIGS. 6, 7 it is shown that the cantilever 20 has no drilling station at its operational end that is integral with the cantilever, e.g. with a mast or derrick integrated with the cantilever structure. Instead the cantilever 20 is adapted to receive on a deck 50 thereof a mobile drilling station 60 for subsea drilling activities, e.g. including well maintenance activities. The mobile drilling station 60 can be placed on the deck 50 when it is needed, and may be removed when not in use, or—as will be explained below—the station 60 would form an obstacle on deck for crane 70.

For example, the drilling station 60 may be composed mainly of containerized components, i.e. components have a shape and dimensions such that they can be transported as ISO freight containers.

The mobile drilling structure 60 could include a base 62 to be placed on deck 50 and a mast 61. A mobile drilling tubular handling device 65 is also stationed on the deck 50, allowing to move tubulars between the drilling structure 60 and a storage (which may also be mobile to allow for complete clearing of the deck 50).

The cantilever 20 may house auxiliary equipment for drilling activities, e.g. mud handling, etc.

As is preferred the cantilever deck 50 is a top deck of the cantilever 20. Preferably the deck 50 is a flush, planar and horizontal deck, preferably extending over the entire length of the cantilever or preferably at least over a length of 20 meters with a width of 8 meters.

In a preferred embodiment the deck 50 and/or a base of the mobile drilling station 60 can be provided with an X-Y displacement mechanism, e.g. including two pairs of orthogonal skid beams, allowing to displace the mobile station 60 in X-Y manner relative to the top deck for servicing a two-dimensional array of wells. It will be appreciated that this optional feature can be dispensed with if this displacement is performed with the cantilever 20 itself.

The cantilever is provided with a crane 70. In this example, as is preferred, the crane 70 is a pedestal crane having a crane base 71 embodied as pedestal and a 360° revolving column 74 on the pedestal. The column 74 here supports main crane boom 72 that is then slewable about a vertical axis, preferably revolvable about 360°. The column 74 supports or houses one or more winches, at least one main hoist winch for a main hoist cable 75 from which a main hoist hook 76 is suspended. The boom 72 is pivotable about a horizontal axis 72*a*, here relative to the column 74, here by a luffing cable 77 and winch arrangement as is known in the art of pedestal cranes.

The cantilever structure is provided with a pair of parallel crane support rails 52 extending in longitudinal direction of the cantilever 20, here along opposed sides of the deck 50 as is preferred. As is preferred the rails 52 here extend over the entire length of the cantilever 20, but shorter rails are also envisaged. It is preferred that the crane support rails extend over at least 80% of the length of the cantilever 20.

The crane base 71 travels over and engages on each of the crane support rails 52.

As is preferred, the rails 52 are embodied as skid beams and the crane base 71 is embodied to skid over said rails 52. The base 71 here has two pairs of spaced apart skid members 73 engaging on each of the rails 52.

In view of structural stability the rigid cantilever structure has two parallel cantilever beams 27 at its bottom side and the crane support rails 52 are each mounted vertically above a respective cantilever beam 27. The cantilever structure includes a vertical and load bearing wall 53 between each cantilever beam 27 and crane support rail 52 there above. For example each wall is a latticed structure, here clad with panels to provide an interior space in the cantilever that is sheltered from the environment.

The crane 70 has an operational reach that extends beyond the contour of the cantilever, at least beyond the operational end 21 of the cantilever 20, so as to allow for lifting operations outside the contour of the cantilever 20.

Compared to a crane at a fixed location on deck of the rig, as in the prior art, this crane on the cantilever 20 can benefit from the extension capabilities of the cantilever to enhance its reach and/or effective lifting capabilities. For instance this crane 70 is less hindered by jack-up legs 4 at either side of the cantilever 20 and thereby has a great operational envelope for lifting operations beyond the contour of the cantilever (including in extended position of the cantilever).

FIG. 7 shows the crane 70 in a position close to the inner end of the cantilever. It is envisaged that the remaining clear deck space of deck 50 is then still large enough to accommodate a mobile drilling station 60 thereon.

In FIG. 7 the mobile drilling station has been removed from the deck 50, e.g. using the crane 70, and the crane 70 has travelled to the operational end of the cantilever 20. The cantilever 20 itself is in a extended position, so that the crane 70 now has a reach far beyond the deck box of the rig.

In view of operational reach of the crane it is proposed as an embodiment that the main boom 72 of the crane is longer than the length of the cantilever 20. If desired, as is known in the art, the main boom may be of adaptable length, e.g. composed a interconnected boom sections, e.g. latticed boom section.

The flush horizontal deck 50 may be provided with a hatch covered opening 90 therein at a location for a firing line for drilling activities to be performed with a mobile drilling station 60 that can be placed on the deck 50.

It is also envisaged that the crane 70 can be used to transfer a mobile drilling station 60 from the rig onto an offshore platform on which the station 60 is placed to perform drilling or other borehole related activities.

Whilst not shown in the figures for reason of clarity the motions of the cantilever in its longitudinal and rotational direction, and of the crane 70 over the rails 52 on the cantilever 20, are preferably performed—as is known in the art, e.g. from the cited references—by making use of skidding equipment, e.g. with one or more hydraulic skid jacks between the carrier device 40 and the one or more rails 35 to effect the displacement of the carrier device 40 and thereby the entire cantilever 20. Such hydraulic skid jacks are generally known in the art. In combination therewith or as an alternative hydraulic skid jacks can be arranged between each cantilever beam and each assembly 12 to move the cantilever in longitudinal direction. Also a hydraulic skid jack may be arranged between each assembly 12 and the first rail 10 to perform the rotational motion of the cantilever 20. As is known in the art one or more operable locking pins may be provided to lock one end of the skid jack on the rail or beam, said rail or beam being provided with holes or similar.

It will be appreciated that instead of hydraulic skid jacks other drives, e.g. a drive with a rotary pinion meshing with a toothed rack, may also be employed for performing the cantilever motions.

The invention claimed is:

1. An offshore system comprising:

a rig having a deck supporting structure provided with a deck, said deck supporting structure having a side, a cantilever having a rigid cantilever structure with an operational end, said operational end including a drilling station, said rigid cantilever structure having an inner end opposite the operational end and said rigid cantilever structure having one or more cantilever beams in the longitudinal direction of the cantilever, wherein the cantilever is mounted on the deck so as to be movable in longitudinal direction of the cantilever, in rotational direction, and in combinations thereof, allowing movement of the cantilever between a retracted position and extended positions wherein the operational end of the cantilever extends over said side beyond the deck supporting structure, wherein the rig is provided with a first support rail which extends along said side of the deck supporting structure, wherein one or more travelling and swivelling assemblies are arranged between said first support rail and the one or more cantilever beams, each assembly having a lower member which travels over the first support rail, an upper member over which the one or more cantilever beams travel in their longitudinal direction, and a vertical pivot axis swivel between said lower and upper member of the assembly, wherein the rig is provided with one or more second support rails that extend over the deck in a direction transverse to the first support rail, wherein the system comprises a cantilever inner end carrier device which travels over and engages on said one or more second support rails, and wherein the cantilever inner end carrier device is connected via a vertical pivot axis swivel to a connector part of the rigid cantilever structure at or near its inner end to provide a rotation axis at a fixed location relative to the rigid cantilever structure for the rotational motion of the cantilever, the cantilever inner end carrier device holding the cantilever inner end relative to the deck.

2. The system according to claim 1, wherein the rig is provided with a pair of parallel second support rails, and wherein the cantilever inner end carrier device travels over and engages on each of said second support rails.

3. The system according to claim 2, wherein the vertical pivot axis swivel is mounted on the cantilever inner end carrier device centrally between the pair of parallel second support rails.

4. The system according to claim 1, wherein the deck supporting structure is provided with a transverse bulkhead underneath the deck along the underside of each second support rail so as to transfer forces from said second support rail into the bulkhead.

5. The system according to claim 4, wherein the first support rail is arranged above an outer side wall of the deck support structure so as to transfer forces from said first support rail into said side wall, said outer side wall being connected to said one or more transverse bulkheads.

6. The system according to claim 1, wherein the rigid cantilever structure has two parallel cantilever beams, and wherein between the first support rail and each cantilever beam a travelling and swivelling assembly is arranged.

7. The system according to claim 1, wherein the rig is a jack-up rig having a deck box as deck supporting structure and three or more jack-up legs.

8. The system according to claim 1, wherein the cantilever is provided with a crane having a crane base and a main crane boom that is slewable about a vertical axis and is pivotable about a horizontal axis, wherein the cantilever structure is provided with a pair of parallel crane support rails extending in longitudinal direction of the cantilever, and wherein the crane base travels over and engages on each of said crane support rails, wherein said crane has an operational reach extending beyond a contour of the cantilever, at least beyond the operational end of the cantilever.

9. The system according to claim 8, wherein the cantilever has a cantilever deck that is adapted to place a mobile drilling station thereon, and wherein the crane support rails extend along the sides of said cantilever deck allowing placement of the crane base close to the operational end when no mobile drilling station is present on said cantilever deck.

10. The system according to claim 8, wherein the crane support rails extend over at least 80% of the length of the cantilever.

11. The system according to claim 8, wherein the cantilever structure has two parallel cantilever beams at its bottom side, and wherein the crane support rails are each mounted vertically above a respective cantilever beam, and wherein the cantilever structure includes a vertical and load bearing wall between each cantilever beam and crane support rail there above.

12. The system according to claim 8, wherein the main crane boom of the crane is longer than the length of the cantilever.

13. The system according to claim 8, wherein the cantilever has a top side with a flush horizontal cantilever deck provided with a hatch covered opening therein at a location for a firing line for drilling activities to be performed with a mobile drilling station that can be placed on said flush horizontal cantilever deck, and wherein the crane support rails extend along opposed sides of the flush horizontal cantilever deck.

14. The system according to claim 8, wherein the crane is a pedestal crane having a base embodied as a pedestal and a 360° revolving column on said pedestal, the column supporting one or more winches, at least one main hoist winch for a main hoist cable of the crane.

15. An offshore system comprising:

a rig having a deck supporting structure provided with a deck, said deck supporting structure having a side, a cantilever having a rigid cantilever structure with an operational end, said operational end being adapted to receive a mobile drilling station, said rigid cantilever structure having an inner end opposite the operational end and said rigid cantilever structure having one or more cantilever beams in the longitudinal direction of the cantilever, wherein the cantilever is mounted on the deck so as to be movable in longitudinal direction of the cantilever, in rotational direction, and in combinations thereof, allowing movement of the cantilever between a retracted position and extended positions wherein the operational end of the cantilever extends over said side beyond the deck supporting structure, wherein the rig is provided with a first support rail which extends along said side of the deck supporting structure, wherein one or more travelling and swivelling assemblies are arranged between said first support rail and the one or more cantilever beams, each assembly having a lower member which travels over the first support rail, an upper member over which the one or more cantilever beams travel in their longitudinal direction, and a vertical pivot axis swivel between said lower and upper member of the assembly, wherein the rig is provided with one or more second support rails that extend over the deck in a direction transverse to the first support rail, wherein the system comprises a cantilever inner end carrier device which travels over and engages on said one or more second support rails, and wherein the cantilever inner end carrier device is connected via a vertical pivot axis swivel to a connector part of the rigid cantilever structure at or near its inner end to provide a rotation axis at a fixed location relative to the rigid cantilever structure for the rotational motion of the cantilever, the cantilever inner end carrier device holding the cantilever inner end relative to the deck.

16. The system according to claim 3, wherein the vertical pivot axis swivel is immovably secured to the carrier device.

* * * * *